United States Patent [19]

Miyazaki et al.

[11] Patent Number: 4,566,263

[45] Date of Patent: Jan. 28, 1986

[54] DEVICE FOR STORAGE OF EMPTY BOBBINS FOR A SPINNING FRAME

[75] Inventors: Tsutomu Miyazaki, Kariya; Tatemi Fukuda, Aichi; Kazuya Yoshimine, Kariya, all of Japan

[73] Assignee: Kabushiki Kaisha Toyoda Jidoshokki Seisakusho, Kariya, Japan

[21] Appl. No.: 573,046

[22] Filed: Jan. 23, 1984

[30] Foreign Application Priority Data

Nov. 4, 1983 [JP] Japan ..... 58-171467

[51] Int. Cl.[4] ..... D01H 9/18; D01H 9/14; B07C 5/00

[52] U.S. Cl. ..... 57/276; 57/270; 57/281; 193/27; 209/927

[58] Field of Search ..... 57/268, 266, 270, 276, 57/281; 242/35.5 R, 35.5 A; 209/552, 927; 193/27, 28; 198/534, 560, 562, 651

[56] References Cited

U.S. PATENT DOCUMENTS

| | | | |
|---|---|---|---|
| 1,457,177 | 5/1923 | Lee | 193/27 X |
| 3,195,298 | 7/1965 | Furst | 242/35.5 R X |
| 3,447,297 | 6/1969 | DuBuis et al. | 57/270 |
| 4,076,132 | 2/1978 | Thompson et al. | 57/281 X |
| 4,181,228 | 1/1980 | Hashimoto et al. | 209/552 |
| 4,351,494 | 9/1982 | Schippers et al. | 242/35.5 A |

FOREIGN PATENT DOCUMENTS

| | | | |
|---|---|---|---|
| 1477855 | 12/1969 | Fed. Rep. of Germany | 193/27 |
| 54-106630 | 8/1979 | Japan . | |
| 76530 | 5/1983 | Japan . | |
| 2061333 | 5/1981 | United Kingdom | 57/281 |

*Primary Examiner*—John Petrakes

*Attorney, Agent, or Firm*—Brooks Haidt Haffner & Delahunty

[57] ABSTRACT

The spinning frame of the invention comprises a passage through which empty bobbins returned by conveyor means provided above the spinning frame are guided towards empty bobbin supply sections associated with automatic bobbin changer annexed to the spinning frame. Halfway in the guide passage are a branch point for branching the guide passage into left and right side sections and a distributer for distributing empty bobbins. Below said branch point and halfway in the left and right side sections are storage sections for storing the empty bobbins in horizontal position.

9 Claims, 8 Drawing Figures

DEVICE FOR STORAGE OF EMPTY BOBBINS FOR A SPINNING FRAME

BACKGROUND OF THE INVENTION

This invention relates to a guide passage and storage device by means of which empty bobbins discharged from the winder are guided towards supply sections for empty bobbins associated with the bobbin changer of the spinning frame.

In keeping pace with the automation of the spinning process, a spinning frame directly coupled to a winder has become very popular. In this case, fully packaged bobbins prepared in the spinning frame are transferred to the winder where the yarn is unwound from the bobbin into a package and the empty bobbins discharged from the winder are automatically supplied to empty bobbin supply sections associated with the automatic bobbin changer of the spinning frame, so as to be used again for winding the yarn at the spinning frame.

In the abovementioned system, it is necessary to temporarily store the empty bobbins returned from the winder. As such storage means, there is disclosed in the Japanese Provisional (laid-open) Patent Publication No. 106630/1979 a device for storing empty bobbins on an empty bobbin return conveyor provided at a position above the main part of the spinning frame.

In this device, the empty bobbins are placed on the return conveyor with the large ends of the bobbins oriented in the proceeding direction of the return conveyor which is driven permanently. The empty bobbins are stored sequentially in a line at the conveyor end in the lengthwise direction with the aid of the empty bobbin stopper as the bobbins are transported on the conveyor. The stopper is turned on and off for forwarding the empty bobbins to empty-bobbin supply sections of the automatic bobbin changers annexed to the spinning frame.

In this prior-art device, the conveyor is likely to be worn out because it is driven permanently and moreover the empty bobbins are stored thereon in sliding contact therewith. In addition, the operational timing of the bobbin stopper needs to be controlled by complicated control means.

Instead of driving the bobbin return conveyor permanently, it may be driven only when required to supply the empty bobbins to the spinning frame. In this case, however, the conveyor drive control system may be complicated. In addition, when the empty bobbins should be transported from the winder during the conveyor dwell time, these bobbins are accumulated at the loading side of the conveyor while it is impossible to load these empty bobbins on the conveyor.

SUMMARY OF THE INVENTION

It is therefore a principal object of the present invention to obviate the aforementioned deficiency of the prior art device and to provide a supply device which is simple in structure and facilitated in maintenance and in which there is no need to store empty bobbins on the bobbin return conveyor disposed above the main part of the spinning frame of the type directly connected to the winder.

In view of the foregoing object, the present invention is directed to a spinning frame in which the empty bobbins returned by a conveyor mounted above the main part of the spinning frame are conveyed by a guide passage to empty bobbin supply sections associated with the automatic bobbin changer annexed to the spinning frame. According to the present invention, there are provided, halfway in the guide passage, a branch point for dividing said guide passage into left and right sections and a distributing member associated with said branch point and, halfway in the left and right side sections of the guide passage and below said branch point, storage sections for storing the empty bobbins in horizontal position.

That is, the main advantage of the present invention resides in the fact that, because the empty bobbins are not stored on the bobbin return conveyor, complicated control means such as drive control means for said empty bobbin stopper or return conveyor may be eliminated, the empty bobbins may be stored by a simplified structure, and storage sections may be provided on both sides of the spinning frame thus assuring a sufficient storage volume of the empty bobbins.

BRIEF DESCRIPTION OF THE DRAWINGS

The invention will become more readily apparent from the following description of a preferred embodiment thereof shown, by way of example only, in the accompanying drawings, in which.

DESCRIPTION OF THE PREFERRED EMBODIMENT

Reference is now had to FIGS. 1 to 8 showing a preferred embodiment of the present invention.

Figure 1:
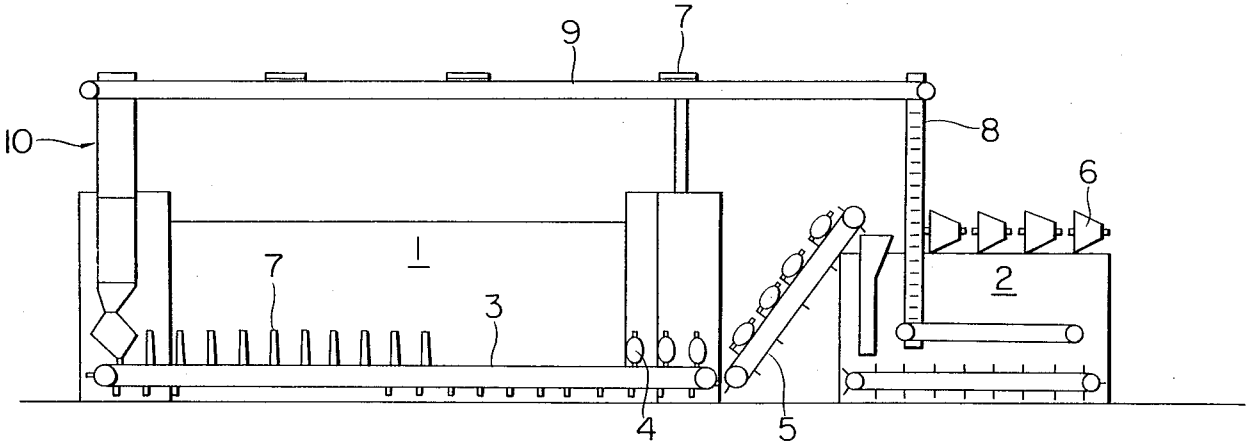
FIG. 1 shows in schematic side view the overall system to which the present invention is applied.
Figure 2:
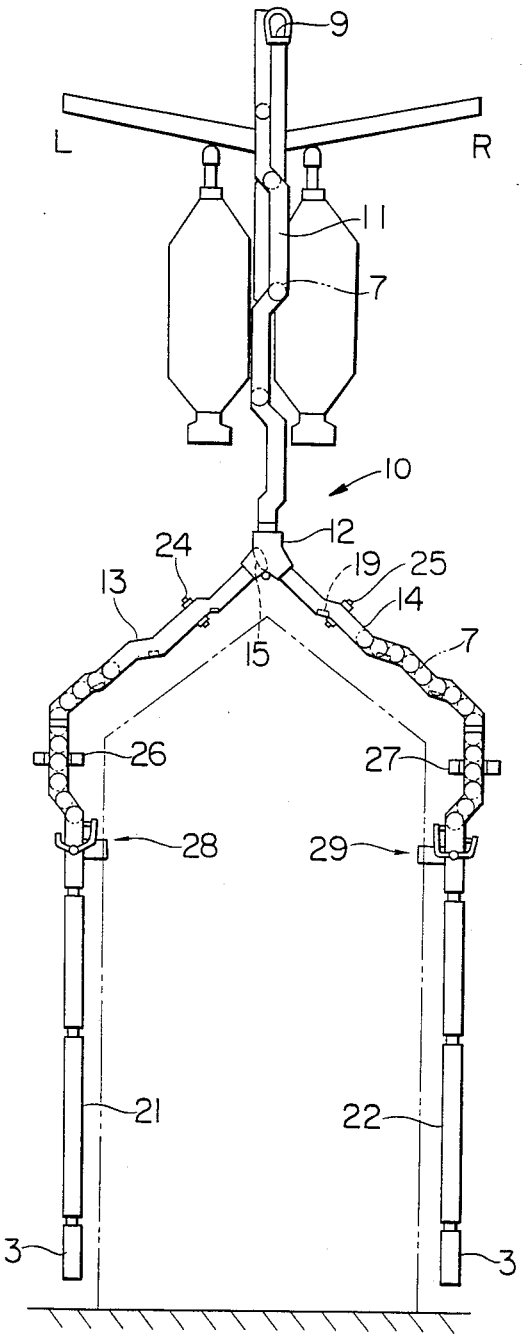
FIG. 2 is a front view showing essential portions of the storage device of the present invention.
Figure 3:
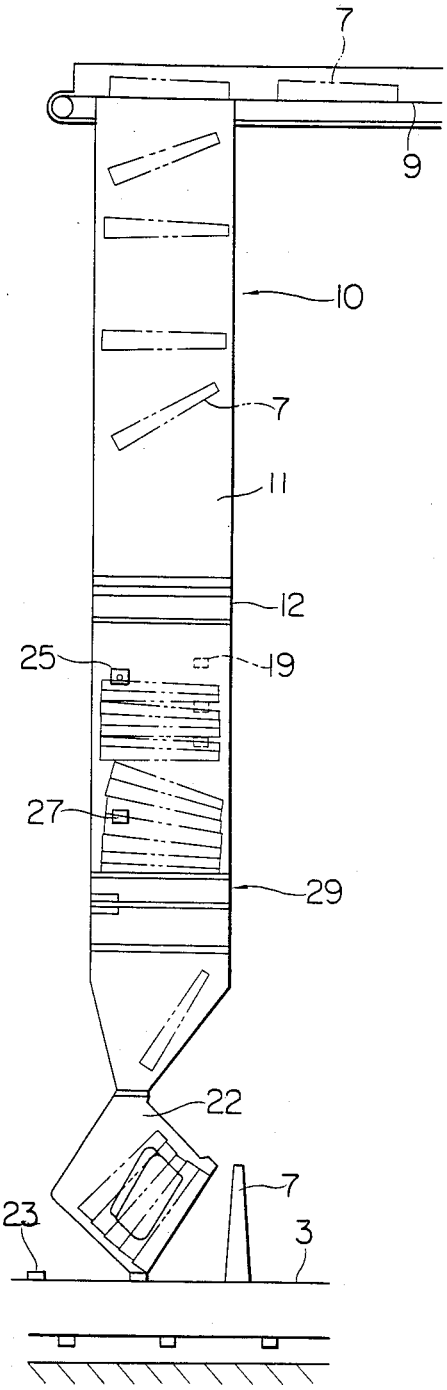
FIG. 3 is a side view thereof.
Figure 4:
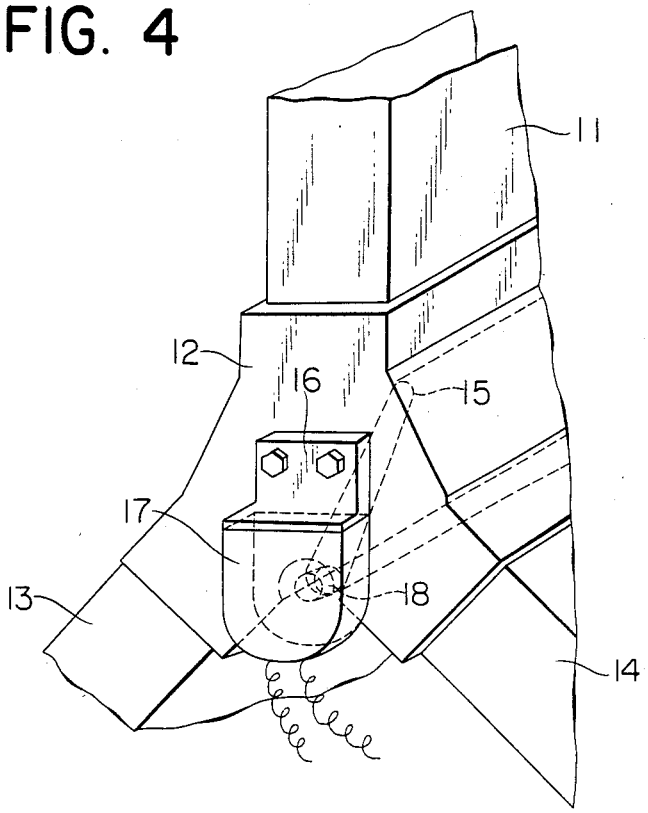
FIG. 4 is a perspective view showing the branch point and the distributing member forming a part of the storage device of the present invention.
Figure 5:
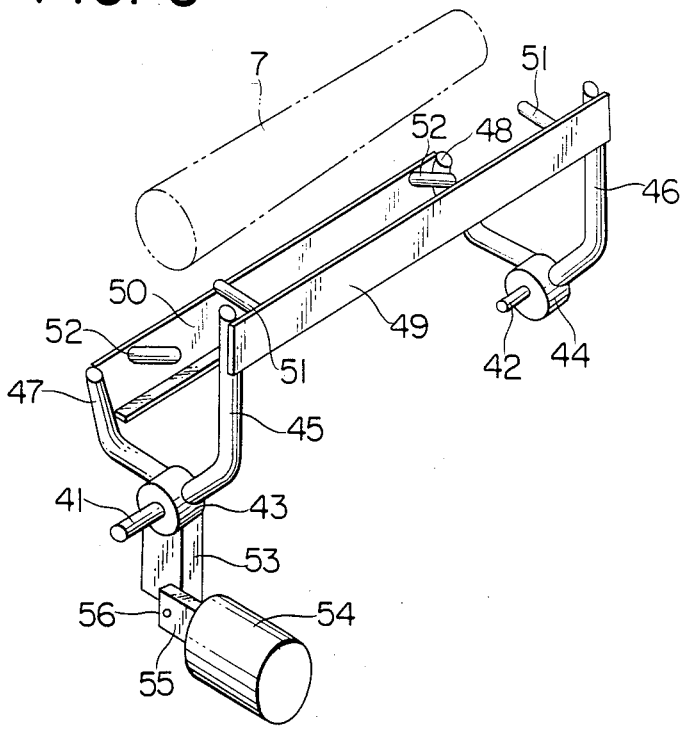
FIG. 5 is a perspective view showing the separation and forwarding unit also forming a part of the storage device of the present invention.
Figure 6:
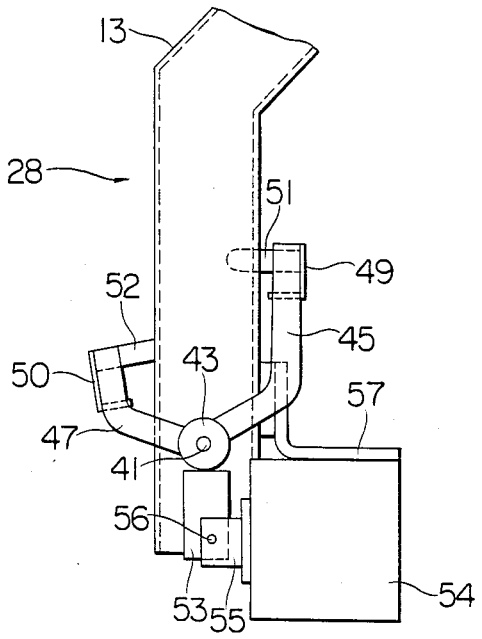
FIGS. 6 to 8 are front views thereof for explaining the operation of the separation and forwarding unit.

Referring first to FIG. 1, there is shown a spinning frame 1 provided with an automatic bobbin change device or devices of any suitable construction, not shown. The spinning frame 1 is connected to a winder 2 of any suitable construction through transport conveyors 5, 8, an empty bobbin return conveyor 9 and a guide passage 10, which are mounted one after the other or in tandem between the spinning frame and winder. The transport conveyor 5 is adapted for transporting to the winder 2 of fully packaged bobbins 4 transported thereto by a conveyor 3 associated with said bobbin change devices, while the transport conveyor 8 is adapted for transporting to an upper part of the winder 2 of empty bobbins 7, that is, the bobbins from which the yarn has been unwound at winder 2 into a package 6. The empty bobbin return conveyor 9 is provided at a position above the main part of the spinning frame and adapted to transport empty bobbins 7 transported by conveyor 8 to the end of the spinning frame opposite to the winder 2. The guide passage 10 is adapted to receive empty bobbins 7 transported by return conveyor 9 and forward them to conveyor 3.

The upper part of the guide passage 10 extending from upper to mid points is a single zigzag-shaped conduit 11 of a rectangular cross-section. At the lower end of the conduit 11 is a branch point 12 from which two conduits 13, 14 of rectangular cross-section are extended on either sides of the spinning frame, said conduits 13, 14 presenting upper zigzag-shaped sections. A distributing lever 15 is provided at the branch point 12 for distributing the empty bobbins 7 into conduits 13, 14. The distributing lever 15 is mounted to a driving shaft 18 of an electrically operated rotary solenoid 17 mounted in turn to the point 12 by a supporting arm 16. The lever end opposite to rotary solenoid 17 is carried by a shaft (not shown) fixed to point 12. Guide members 19 are secured to the side of the lower wall of conduits 13, 14 through which pass the small ends of the empty bobbins in order to prevent the empty bobbins from tilting with small ends downwards when passing through conduits 13, 14.

The conduits 13, 14 are connected at their lower ends to empty bobbin reserve units 21, 22 of any suitable structure, which reserve units 21, 22 are operative to store several empty bobbins 7 and to guide the lower ends of these bobbins 7 into engagement with pegs 23 provided to the conveyor 3.

The upper zigzag-shaped conduit sections of the conduits 13, 14 of the rectangular cross-section are adapted for storage of empty bobbins 7. The upper and lower parts of the zigzag-shaped conduit sections are provided respectively with photoelectric units 24, 25 for sensing the upper limit and photoelectric units 26, 27 for sensing the lower limit of the heap of empty bobbins 7. Connected to the lower ends of these conduit sections are empty bobbin separation and forwarding units 28, 29.

The separation and fowarding unit 28 mounted to conduit 13 is hereafter explained by referring to FIGS. 5 to 8. To the outside of front and rear wall surfaces of conduit 13, there are turnably mounted bosses 43, 44 about supporting shafts 41, 42. A pair of upper arms 45, 46 and a pair of lower arms 47, 48 are projected upwardly from bosses 43, 44.

The upper arms 45, 46 and the lower arms 47, 48 are respectively connected to each other by brackets 49, 50. A pair of upper stop pieces 51 are secured to bracket 49 at an interval from each other corresponding to the interval between mating through-holes in the conduit 13. Similarly, a pair of lower stop pieces 52 are secured to bracket 50 at an interval from each other corresponding to the interval between mating through-holes in the conduit 13.

Extending downwardly from the boss 43 is a lever 53 to which is connected an armature 55 of an electromagnetic solenoid 54 by means of a connecting pin 56, which solenoid 54 is mounted by a supporting bracket 57 to conduit 13. In the above construction of the separation and forwarding unit, the upper and lower pieces 51, 52 are spaced apart vertically from one another and capable of extending into the inside of the conduit 13 through said mating through-holes in the wall sides of the conduit 13. The separation and forwarding unit 29 associated with conduit 14 is similarly constructed to the unit 28 mentioned above.

Figure 7:
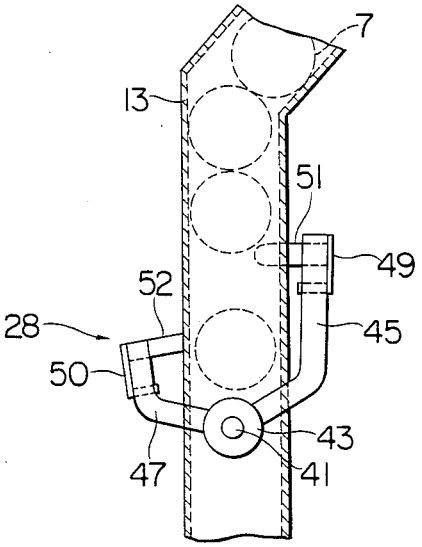
Figure 8:
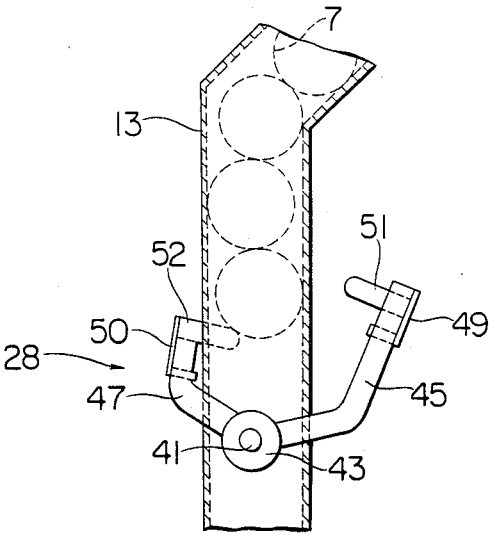

The operation of the separation and forwarding unit 28 is hereafter explained by referring to FIGS. 7 and 8.

When the solenoid 54 is energized and the armature 55 moved towards right, bosses 43, 44 are turned counterclockwise. Hence the upper stop pieces 51 are projected into the conduit 13, while the lower stop pieces 52 are receded out of the conduit 13.

The lowermost empty bobbin 7 so far held by the lower stop piece 52 is allowed to descend through a space between the lower stop piece 52 and the right-hand inner wall side of the conduit 13, whereas the empty bobbin 7 right above said lowermost empty bobbin 7 is held by the upper stop pieces 57.

When the solenoid 54 is deenergized for projecting the armature 55, bosses 43, 44 are turned clockwise, so that upper stop pieces 51 are receded out of conduit 13 and the lower stop pieces 52 projected into conduit 13 (FIG. 8). When this occurs, the empty bobbin 7 temporarily held by the upper stop pieces 51 are allowed to descend and temporarily held by stop pieces 52.

When the solenoid 54 is energized next time, only the lowermost empty bobbin 7 is advanced downwards, as described above.

In the operation of the empty bobbin storage device, fully packaged bobbins 4 produced by the spinning frame 1 and transferred to conveyor 3 by the annexed automatic bobbin change unit are moved towards the conveyor 5 upon demand from the annexed winder 2 and are forwarded to the winder 2 by the conveyor 5. At this time, the fully packaged bobbins 4 at a side L of the spinning frame (or the left side as viewed in FIG. 2) are supplied to the winder 2 and, after all of the bobbins on the side L have been supplied in this manner to winder 2, the fully packaged bobbins 4 on a side R (or the right side as viewed in FIG. 2) start to be supplied to winder 2. The empty bobbins 7, that is, the bobbins from which the yarn has been unwound into a package 6 at winder 2, are transported by conveyor 8 to the region above the winder 2, where they are placed on the return conveyor 9 connecting to the conveyor 8. The empty bobbins thus transported to a region right above guide passage 10 are introduced into guide passage 10 and transported to branch point 12 through zigzag-shaped conduit 11. Reject bobbins with remnant yarn are expelled by means not shown. It should be noted that the empty bobbins 7 are heavier at their lower ends because they are tapered from their lower towards upper ends. Therefore, the empty bobbins descending in a horizontal position at the outset through conduit 11 tend to be tilted gradually and eventually assume a vertical position with their lower ends downwards. However, the bobbins are impinged on the inclined wall of the conduit 11 and thereby restored to their horizontal position as they descend through conduit 11 as is more fully described in our co-pending application Ser. No. 574,841 filed Jan. 27, 1984.

Since it is the fully packaged bobbins 4 on the side L that are supplied firstly to winder 2, distributing lever 15 at the branch point 12 is tilted towards side R by the operation of rotary solenoid 17 for supplying the empty bobbins 7 to the conduits 13 corresponding to the side L. When a senser, not shown, at the right end of the spinning frame as viewed in FIG. 1 senses that all of the fully packaged bobbins 4 on the conveyor 3 on the side L have been discharged and the empty bobbins 7 have been placed below all of the spindles on the side L, the rotary solenoid 17 is energized by commands from the senser so that the distributing lever 15 is tilted towards side L for commencing the supply of empty bobbins to the side R.

The empty bobbins 7 introduced from the branch point 12 into conduit sections 13 or 14 are stored in a closely packed state in a space above the separation and forwarding units 28, 29. On demand from winder 2, conveyor 3 is advanced and the empty bobbins 7 are forwarded from the reserve boxes 21, 22 to the conveyor 3. When an available space has been formed in the reserve boxes 21, 22 for receiving additional bobbins 7, the separation and forwarding units 28, 29 are activated so that the empty bobbins 7 are forwarded into reserve boxes 21, 22.

It should be noted that, during normal system operation, the number of empty bobbins 7 returned from the winder 2 to the spinning frame 1 is roughly equal to the number of fully packaged bobbins 4 delivered to the winder 2 from the spinning frame 1, that is, to the number of empty bobbins 7 delivered to the conveyor 3. Therefore, no drastic change is caused in the stored volume of empty bobbins 7 in the conduit sections 13, 14 and the uppermost one of stored empty bobbins 7 is at a height intermediate the upper level sensers 24, 25 and the lower level sensers 26, 27. However, when some unusual situation arises in the spinning frame and the number of bobbins returned to the spinning frame exceeds the number of bobbins forwarded from the spinning frame, the empty bobbins 7 are stored in the space above the upper level sensers 24, 25. This may cause operational troubles at the distributing lever 15 at the branch point 12. Therefore, the operation of the return conveyor 9 is terminated when the upper level of the heap of stored empty bobbins 7 has reached the upper sensers 24, 25 and the operation is again commenced when the upper level of the heap of empty bobbins 7 has become lower than said upper sensers.

If, on the contrary, the number of empty bobbins 7 returned from winder 2 has decreased on account of, for instance, production of reject empty bobbins, and the upper level of the heap of stored empty bobbins 7 has become lower than the lower limit sensers 26, 27, the belt 3 continuing its operation, the reserve boxes 21, 23 will become deplete of empty bobbins 7. Therefore, the operation of belt 3 is discontinued at such time for avoiding possible failure in the delivery of empty bobbins 7 to the pegs 23 of the belt 3, and again commenced when the empty bobbins 7 have been stored to a level above the lower limit sensers 26, 27.

However, according to the present invention since the empty bobbin storage units are provided to each of the empty bobbin supply sections associated with automatic bobbin changers on both sides of the spinning frame 1, a sufficient amount of spare empty bobbins may be stored and cessation of operation of conveyors 3 or conveyor 9 is not possible except in case of an emergency such as troubles in the spinning frame.

From the foregoing it is seen that the arrangement of the present invention provides a spinning frame directly coupled to a winder and provided with a passage for guiding empty bobbins to the empty bobbin supply sections associated with automatic bobbin changers on both sides of the spinning frame, there being a branch point and associated distributing means halfway in said passage for providing left and right branched conduits for said passage and storage sections halfway in said left and right conduits for storing the empty bobbins in horizontal position. In this manner, despite simple structure and facilitated maintenance of the storage device, a sufficient amount of empty bobbins may be stored to prevent the situation of shortage or depletion of empty bobbins to be supplied to the spinning frame.

What is claimed is:

1. Empty bobbin storage device in a spinning frame comprising conveyor means mounted above the spinning frame and adapted for restoration to the spinning frame of empty bobbins discharged from a winder associated with the spinning frame, said bobbins having predetermined length and width dimensions and the length dimension being greater than the width dimension, guiding means having a passage for guiding the thus returned empty bobbins to empty-bobbin supply sections associated with automatic bobbin change means annexed to the spinning frame, said passage having an input end adjacent said conveyor and an output end and having a branch point intermediate said input end and said output end to provide left and right passage sections extending from said branch point towards left and right sides of the spinning frame, and distributing means associated with said branch point for selectively distributing the empty bobbins into one or the other of said passage sections, characterized in that, said left and right passage sections have, below said branch point, storage sections for storing a plurality of said empty bobbins, said storage sections, in a cross-section transverse to the direction of movement of the bobbins from said branch point to said output end, having a passage width dimension at least equal to the length dimension of a bobbin and a dimension transverse to said passage width dimension at least equal to the width dimension of a bobbin but less than the passage width dimension whereby each of the bobbins is stored in said storage sections with its length dimension extending in the horizontal direction.

2. The storage device as claimed in claim 1, characterized in that said guiding means, above said branch point, is a single zigzag-shaped conduit.

3. The storage device as claimed in claim 1, characterized in that said distributing means comprises a distributing lever pivotally supported at said branch point and means for driving said distributing lever.

4. The storage device as claimed in claim 3, characterized in that said driving means is a rotary solenoid.

5. The storage device as claimed in claim 1, wherein said bobbins have an end which is smaller than the opposite end thereof and characterized in that a guide member is disposed at that part of the lower inner wall of each said guide passage section through which the small ends of the empty bobbins pass for preventing the bobbins from tilting with said small ends downwards.

6. The storage device as claimed in claim 1, characterized in that the lower ends of said passage sections are connected to empty-bobbin reserve boxes.

7. The storage device as claimed in claim 1, characterized in that said storage sections are zigzag-shaped conduits.

8. Empty bobbin storage device in a spinning frame comprising conveyor means mounted above the spinning frame and adapted for restoration to the spinning frame of empty bobbins discharged from a winder associated with the spinning frame, and a passage for guiding the thus returned empty bobbins to empty-bobbin supply sections associated with automatic bobbin change means annexed to the spinning frame characterized in that, halfway in said passage, there are provided a branch point for branching said passage towards left and right sides of the spinning frame for providing two guide passage sections, and means associated with said branch point for selectively distributing the empty bobbins into one or the other of said guide passage sections, and in that, halfway in the left and right guide passage sections, and below said branch point, there are provided storage sections for storing said empty bobbins in horizontal position, said storage sections being zigzag-shaped conduits and each said storage section comprising an upper limit senser for empty bobbins, a lower limit senser for empty bobbins, and separation and forwarding means for empty bobbins extending downwardly of said upper and lower limit sensers.

9. The storage device as claimed in claim 8, characterized in that each said separtion and forwarding means comprises a pair of lower arms and a pair of upper arms integrally pivotally supported for advancing from and receding into opposite sides of said stroage saections and means for pivoting these arms integrally and in opposite phase to each other, one or the other pair of said upper or lower arms when projecting into said storage sections supporting both ends of said empty bobbins.

* * * * *